United States Patent [19]

Tosa

[11] Patent Number: 4,733,980

[45] Date of Patent: Mar. 29, 1988

[54] PRINTER

[75] Inventor: Takashi Tosa, Tamayama, Japan

[73] Assignee: Alps Electric Co., Ltd., Japan

[21] Appl. No.: 942,188

[22] Filed: Dec. 16, 1986

[30] Foreign Application Priority Data

Jan. 30, 1986 [JP] Japan ..... 61-10949[U]

[51] Int. Cl.[4] ..... B41J 35/06; B41J 35/28

[52] U.S. Cl. ..... 400/207; 400/120; 400/208

[58] Field of Search ..... 400/248, 207, 208, 208.1, 400/120, 194–196.1; 219/216

[56] References Cited

U.S. PATENT DOCUMENTS 4,387,380 6/1983 Asakura ..... 400/120
4,564,848 1/1986 Kuzumi ..... 400/208
4,611,936 9/1986 Yasui ..... 400/208

FOREIGN PATENT DOCUMENTS 0201889 11/1984 Japan ..... 400/248

*Primary Examiner*—Edgar S. Burr
*Assistant Examiner*—James Lisehora
*Attorney, Agent, or Firm*—Guy W. Shoup

[57] ABSTRACT

A printer of heat-sensitive transfer type has a horizontally arranged ink ribbon cassette to print a sheet of printing paper with the ink ribbon. The printer comprises: a platen for holding thereon the printing paper; a horizontal printing head made movable along the platen for bringing the ink ribbon into close contact with the printing paper held on the platen to thermally transfer the ink of the ink ribbon onto the printing paper; and a carriage made movable longitudinally of the platen, while carrying the printing head thereon, in accordance with the printing operation of the printing head. An ink ribbon peeling member is arranged horizontally on the sides of the printing head and carried together with the printing head by the carriage for sequentially peeling off that portion of the ink ribbon, which has been used for the printing operation, from the printing paper.

3 Claims, 2 Drawing Figures

PRINTER

BACKGROUND OF THE INVENTION

1. Field of the Invention

The present invention relates to a printer and, more particularly, to a printer of heat-sensitive transfer type, which is intended to have a thin structure.

2. Description of the Prior Art

A printer of heat-sensitive transfer type according to the prior art has heretofore used a detachable ink ribbon cassette which holds an ink ribbon. This ink ribbon cassette has its spools wound with a number of turns of tape-shaped ink ribbon, which is unwound, when used, and brought into a printing position.

This printing position is defined by a platen and a printing head, which are arranged in upright positions so that the ink ribbon brought into a printing zone is positioned to have an upright width.

Upon application of heat by the printing head, on the other hand, the ink is melted to stick to the printing paper. In order to prevent the ink ribbon and the printing paper from sticking, there is provided in the ink ribbon cassette a mechanism for peeling off the ink ribbon from the printing paper.

Since the printing head and the platen are arranged in the upright positions, however, it has been difficult to make the printer thin because reduction in its height is restricted. On the other hand, it has been difficult to provide the ink ribbon cassette for use with a thin printer with a suitable ink ribbon peeling mechanism

SUMMARY OF THE INVENTION

The present invention has been conceived in view of the background thus far described and has an object to provide a printer which can be made thin although it is equipped with the ink ribbon peeling mechanism.

In order to achieve this object, according to the present invention, there is provided a printer of heat-sensitive transfer type for use with an ink ribbon cassette to print a sheet of printing paper with the ink ribbon of said cassette, comprising: a platen for holding thereon the printing paper; a printing head made movable over said platen for bringing said ink ribbon into close contact with said printing paper held on said platen to thermally transfer the ink of said ink ribbon onto said printing paper; and a carriage made movable longitudinally of said platen, while carrying said printing head thereon, in accordance with the printing operation of said printing head, wherein the improvement comprises ink ribbon peeling means arranged around the sides of said printing head and carried together with said printing head by said carriage for sequentially peeling off that portion of said ink ribbon, which is used for said printing operation, from said printing paper.

According to the present invention, the ink ribbon used for the printing operation is sequentially separated from the surface of the printing paper by the ink ribbon peeling means which is arranged in the horizontal position. As a result, the ink ribbon can be peeled off without attaching the peeling means to the ink ribbon cassette.

BRIEF DESCRIPTION OF THE DRAWING

Other objects, features and advantages of the present invention will become apparent from the following description made with reference to the accompanying drawing, in which.

DESCRIPTION OF THE PREFERRED EMBODIMENT

The present invention will be described in the following in connection with its one embodiment with reference to the accompanying drawing.

Figure 1:
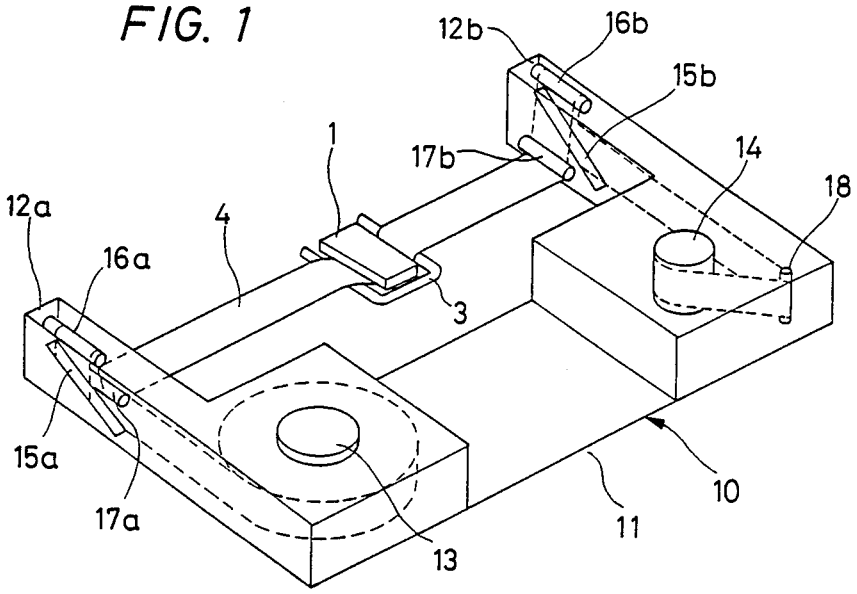
FIG. 1 is a perspective view showing one embodiment of the present invention.
Figure 2:
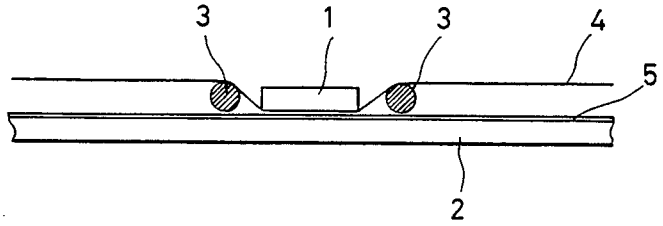
FIG. 2 is an enlarged section showing the detail of the printing head and its neighborhood of the embodiment of FIG. 1.

As shown in FIGS. 1 and 2, a printing head 1 is arranged in a horizontal position to form a thin printer (the whole structure is not shown) and is carried on a carriage (not shown) so that it can move over a platen 2. The printing head 1 is framed on its sides by the legs of an ink ribbon peeling member 3. This ink ribbon peeling member 3 is joined in the form of a letter "U" to the carriage. An ink ribbon 4 is guided over the legs of peeling member 3 onto the printing surface of the printing head 1. On the other hand, a sheet of printing paper 5 is held on the platen 2 which is arranged in a horizontal position.

An ink ribbon cassette 10 charged with the ink ribbon 4 is arranged horizontally and is equipped with guide means for orienting the ink ribbon horizontally in the printing zone so that it may be used with the thin printer body.

The ink ribbon cassette 10 is constructed of a case 11 having box-shaped compartments at its right and left sides. From the two side ends of the case 11, there project a pair of guide portions **12*a* and 12*b*, each of which is equipped therein with a plurality of ribbon guide rollers. In one of the box-shaped compartments, there is disposed a supply spool 13 which has a rotatable core wound with an ink ribbon. In the other of the box-shaped compartments, on the other hand, there is disposed a take-up spool 14 which has its core rotatable for taking up thereon the ink ribbon as it is used. The latter spool 14 is rotationally driven in accordance with the printing state by a drive mechanism mounted in the printer body, after the ink ribbon cassette 10** has been attached to the printer body.

The guide portion **12*a* is equipped with: a sloped guide roller 15*a* for guiding the upright ink ribbon 4 let off from the supply spool 13 in an upward direction; a reversing guide roller 16*a* for reversing the upward ink ribbon 4 coming from the sloped guide roller 15*a* in a downward direction; and a turning tensile guide roller 17*a* for turning the downward ink ribbon 4 coming from the reversing guide roller 16*a* into a horizontal direction and for tensioning the same. Likewise, the guide portion 12*b* is equipped with a sloped guide roller 15*b*, a reversing guide roller 16*b* and a turning tensile guide roller 17*b*, which have respectively the same functions and are symmetrically arranged to guide the ink ribbon 4 from the printing position to a guide roller 18**.

With the construction thus far described, in the ink ribbon cassette 10, the ink ribbon 4 let off from the supply spool 13 is turned at 90 degrees in the upward direction by the sloped guide roller **15*a*, reversed in the downward direction by the reversing guide roller 16*a*, turned in the horizontal direction by the turning tensile guide roller 17*a*, and tensioned by the pairing turning tensile guide rollers 17*a* and 17*b*. These guide rollers 17*a* and 17*b* define the printing zone inbetween. The ink ribbon 4 coming from the guide roller 17***a* is turned from its horizontal to vertical positions by the guide roller 17*a*. The ink ribbon 4 thus turned is reversed from its upward to downward positions by the guide roller 16*b* and is then guided into the upright position until it is taken up on the take-up spool 14 through the guide roller 18.

When the ink ribbon cassette 10 thus constructed is to be attached to the printer body, the ink ribbon 4 existing in the printing zone is pulled along the lower surface of the printing head 1 such that its portions located at the two sides of the head 1 ride on the two legs of the ribbon peeling member 3. In other words, the ink ribbon 4 runs between the printing head 1 and the ribbon peeling member 3.

If the main switch of the printer is turned on in this state, the carriage is moved to carry the printing head 1 to a print starting position. Following this movement, the ink ribbon peeling member 3 is also carried to the print starting position. When the heating resistor of the head 1 is then energized, the carriage is responsively driven to carry the head 1 in the direction of the lines of the printing paper 5. The ink ribbon peeling member 3 is also carried so that the used ink ribbon 4 contacting closely with the printing paper 5 is sequentially peeled off by the drive of the head 1.

As has been described hereinbefore, according to the present invention, the U-shaped peeling member 3 is provided to surround the printing head 1 and is carried by the carriage. As a result, it is possible to make a thin printer and to simplify the structure of the ink ribbon cassette.

Moreover, the ink ribbon corresponding to the horizontal arrangements of the printing head and the platen can be peeled off in accordance with the driving state of the head. As a result, the problems accompanying the horizontal arrangement of the ink ribbon in the printing zone can be solved to permit making a thin printer.

What is claimed is:

1. In a printer of the heat-sensitive transfer type having a platen for holding a printing paper thereon, a printing head supported on a carriage movable along the platen in a horizontal plane, an ink ribbon cassette for supplying an ink ribbon to a printing position in contact with the printing head for thermally transferring ink from the ink ribbon to the printing paper, the improvement comprising:

said ink ribbon cassette being arranged horizontally and provided with a supply spool having the ink ribbon wound on its core with its width oriented in an upright direction perpendicular to the horizontal direction, a take-up spool for winding the ink ribbon on its core with its width oriented in the upright direction, and guide means including a first sloped guide roller for guiding the ink ribbon from the supply spool and turning it to run upward in the upright direction, a first reversing roller for reversing the ink ribbon to run from upward to downward in the upright direction, a first turning tensile roller for turning the downward running ink ribbon from the first reversing roller to run in the horizontal direction toward the printing position and for tensioning the same, a second turning tensile roller for turning the horizontal running ink ribbon from the printing position to run upward in the upright direction and for tensioning the same, a second reversing roller for reversing the ink ribbon to run from upward to downward in the upright direction, and a second sloped guide roller for turning the downward running ink ribbon so that its width is oriented in the upright direction and guiding the ink ribbon to the take-up spool; and ink ribbon peeling means around the printing head carried together on the carriage with the printing head for sequentially peeling off the portion of the ink ribbon which has been used for printing from the printing paper.

2. A printer according to claim 1, wherein said ink ribbon peeling means includes an ink ribbon peeling member surrounding at least two opposite sides of said printing head in the horizontal direction.

3. A printer according to claim 2, wherein said ink ribbon peeling member is made of a U-shaped rod which has its two legs facing said two sides of said printing head.

* * * * *